US005486317A

United States Patent [19]

Dorset et al.

[11] Patent Number: 5,486,317

[45] Date of Patent: Jan. 23, 1996

[54] PROCESS FOR MAKING DETERGENT GRANULES BY NEUTRALIZATION OF SULPHONIC ACIDS

[75] Inventors: Andrew Dorset, Kingston Park, Great Britain; Olivier Paquatte, Strombeek-Bever, Belgium

[73] Assignee: The Procter & Gamble Company, Cincinnati, Ohio

[21] Appl. No.: 284,591

[22] PCT Filed: Jan. 27, 1993

[86] PCT No.: PCT/US93/00736

§ 371 Date: Aug. 10, 1994

§ 102(e) Date: Aug. 10, 1994

[87] PCT Pub. No.: WO93/16154

PCT Pub. Date: Aug. 19, 1993

[30] Foreign Application Priority Data

Feb. 14, 1992 [EP] European Pat. Off. ..... 92870026

[51] Int. Cl.[6] ..... C11D 1/12; C11D 11/00; C11D 11/04; C11D 17/06

[52] U.S. Cl. ..... 252/549; 252/558; 252/174; 252/174.14; 23/313 R

[58] Field of Search ..... 252/549, 558, 252/553, 174.14, 556, 174; 23/313 R

[56] References Cited

U.S. PATENT DOCUMENTS

| | | | |
|---|---|---|---|
| 4,515,707 | 5/1985 | Brooks | 252/368 |
| 4,721,580 | 1/1988 | Gosselink | 252/90 |
| 4,919,847 | 4/1990 | Barletta et al. | 252/558 |
| 4,970,017 | 11/1990 | Nakamura et al. | 252/174.13 |
| 5,164,108 | 11/1992 | Appel et al. | 252/174 |
| 5,178,798 | 1/1993 | Jolicoeur | 252/553 |

FOREIGN PATENT DOCUMENTS

| | | |
|---|---|---|
| 0402112 | 12/1990 | European Pat. Off. . |
| 0438320 | 7/1991 | European Pat. Off. . |
| 2221695 | 2/1990 | United Kingdom . |

*Primary Examiner*—Christine Skane
*Assistant Examiner*—Lorna M. Douyon
*Attorney, Agent, or Firm*—Ken K. Patel; Jacobus C. Rasser; Jerry J. Yetter

[57] ABSTRACT

A process for making a detergent particle comprises neutralization of the acid form of an anionic surfactant in a high shear mixer by a stoichiometric excess of finely divided particulate neutralizing agent having an average particle size of less than 5 μm. A free-flowing detergent composition is made with the process.

9 Claims, No Drawings

PROCESS FOR MAKING DETERGENT GRANULES BY NEUTRALIZATION OF SULPHONIC ACIDS

FIELD OF THE INVENTION

The present invention relates to a process for dry neutralization of sulphonic acids and to detergent compositions made by this process.

BACKGROUND OF THE INVENTION

Granular detergents have so far been principally prepared by spray drying. In the spray drying process the detergent components, such as surfactants and builders, are mixed with as much as 35–50% water to form a slurry. The slurry obtained is heated and spray dried which requires high energy input and expensive equipment. An efficient method of processing detergents without slurrying in water and then subsequently drying would be less expensive.

Processes for "dry" neutralization (ie essentially water free) are well-known and practiced by detergent manufacturers in the manufacture of detergent granules of high bulk density, in particular for the neutralization of acid forms of anionic surfactants.

There is a need however to produce agglomerates that have cleaning performance comparable with conventional spray-dried granules.

It has been discovered that the rate and the completeness of the neutralization reaction can have an impact on the performance and rate of solubility of the detergent granules and therefore represent an important consideration for the commercial application of such a process.

It has now been surprisingly found that the use of finely ground particulate neutralizing agent of a narrowly defined particle size optimises the said neutralization reaction, and in so doing, realises benefits in the performance and rate of solubility of detergent granules of high bulk density made by such "dry" neutralization processes. The detergent granules made by the invention have a bulk density greater than 650 g/l.

U.S. Pat. No. 4,515,707, published May 7, 1985, describes a process for dry neutralization of a detergent sulphuric or sulphonic acid with sodium carbonate powder in the presence of powdered sodium tripolyphosphate in a high shear mixer. The resulting powder is used in the manufacture of solid detergent bars.

Japanese Pat. No. 60 072 999 discloses a batch process whereby a detergent sulphonic acid, sodium carbonate, water and other optional ingredients are brought together in a high shear mixer followed by cooling to 40° C. or below and pulverising with zeolite powder and granulating.

EP A 0 420 317, published Apr. 3, 1991, discloses a continuous process whereby a detergent sulphonic acid, particulate inorganic material, water and other optional ingredients are brought together in a high speed mixer/densifier. Material is subsequently treated in a moderate speed granulator/densifier. Addition of fine powders in the second step, or between the first and second step, is described as beneficial for the agglomeration process.

EP A 0 430 603, published Jun. 5, 1991, discloses a process for preparing high active detergent agglomerates using a finely divided particulate filler with a high oil absorption value as a processing aid for the agglomeration step.

SUMMARY OF THE INVENTION

The present invention relates to a process for making a detergent particle by neutralization of the acid form of an anionic surfactant in a high shear mixer by a stoichiometric excess of finely divided particulate neutralizing agent having an average particle size of less than 5 μm.

The present invention also encompasses free-flowing detergent compositions made with the process.

DETAILED DESCRIPTION OF THE INVENTION

A stream of dry powder ingredients is fed into a high shear mixer where it is mixed with a liquid or paste stream of anionic surfactant acid and, optionally, other liquid binders. The powder stream comprises a particulate neutralizing agent, typically an alkali inorganic salt, and neutralization starts in the high shear mixer and continues during subsequent processing. It is a characteristic of the invention that the particulate neutralizing agent in the powder stream is in the form of a finely ground powder.

THE POWDER STREAM

The powder stream contains a particulate neutralizing agent. Preferred neutralizing agents include any of the salts of carbonate or bicarbonate or mixtures thereof. Especially suitable is calcium or sodium carbonate. The neutralizing agent should be present in a stoichiometric excess over the anionic surfactant acid. Preferably at least five times as much neutralizing agent should be present than is required for stoichiometric neutralization.

The powder stream may also contain any other suitable detergent powders. Preferred powders are those which are active in the detergency process. This includes zeolites, sodium tripolyphosphate, silica, silicates, polymers including copolymers of maleic and acrylic acid, carboxymethyl cellulose, optical brighteners, ethylene diamine tetra acetic acid and inorganic salts such as sulphates. Other suitable ingredients, including additional surfactants, that may be handled as solids are described later.

It has been found that use of a finely ground particulate neutralizing agent improves the cleaning performance, solubility characteristics and cake strength of the final detergent composition. The average particle size of the neutralizing agent should be less than 5 μm. The definitions for average particle size are given below.

It is believed that the high specific surface area of the particulate neutralizing agent improves the efficiency of the neutralization reaction. A narrow range of particle size distribution is preferred, as well as a small average particle size. Preferably 90% of the particles by volume have an equivalent particle size of less than 10 μm.

MEAN PARTICLE SIZE

The definitions of the terms particle size and average particle size as used herein are given below:

The particle size of any given particle is taken to be the diameter of a spherical particle occupying the same volume as the given particle.

The average (or median) particle size is taken to be the particle size which has 50% of the particles by volume smaller than that particle size.

All of the data for particle sizes of the particulate neutralizing agent used herein have been measured on a Malvern series 2600 optical laser.

Any type of mill suitable for grinding the particulate neutralizing agent to the desired particle size may be used. A pan-cake Jet mill provided by Trade Microniser, Kent, England and an air classifier mill, supplied by Hosokawa Micron have been found to be particularly suitable.

THE ANIONIC SURFACTANT

Useful anionic surfactant acids include organic sulphuric reaction products having in their molecular structure an alkyl group containing from about 9 to about 20 carbon atoms and a sulphonic acid. Examples of this group of synthetic surfactants are the alkyl benzene sulphonic acids in which the alkyl group contains from about 9 to about 15 carbon atoms in straight or branched chain configuration.

Especially suitable anionic surfactant acids are linear alkyl benzene sulphonates in which the alkyl group contains from about 11 to about 13 carbon atoms. Other useful surfactant acids include alpha sulphonated fatty acid methyl esters, olefin sulphonates and beta alkyloxy alkane sulphonates.

Mixtures of the above may also be used.

OTHER LIQUID BINDERS

Other liquids may be sprayed into the high shear mixer including amino polyphosphates, diethylene triamine penta acetic acid and additional anionic surfactants (as neutralized salts), nonionic, cationic, ampholytic and zwitterionic surfactants.

Especially suitable amino polyphosphonates include diethylene triamine penta methylene phosphonic acid and ethylene diamine tetra methylene phosphonic acid.

Especially suitable additional anionic surfactants are water-soluble salts of the higher fatty acids. This includes water-soluble salts of the higher fatty acids, i.e., "soaps", are useful anionic surfactants in the compositions herein. This includes alkali metal soaps such as the sodium, potassium, ammonium, and alkylammonium salts of higher fatty acids containing from about 8 to about 24 carbon atoms, and preferably from about 12 to about 18 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap.

Useful anionic surfactants also include the water-soluble salts, preferably the alkali metal, ammonium and alkylolammonium salts, of organic sulfuric reaction products having in their molecular structure an alkyl group containing from about 10 to about 20 carbon atoms and a sulfonic acid or sulfuric acid ester group. (Included in the term "alkyl" is the alkyl portion of acyl groups.) Examples of this group of synthetic surfactants are the sodium and potassium alkyl sulfates, especially those obtained by sulfating the higher alcohols ($C_8$–$C_{18}$ carbon atoms) such as those produced by reducing the glycerides of tallow or coconut oil.

Other anionic surfactants herein are the sodium or potassium salts of alkyl phenol ethylene oxide ether sulfates containing from about 1 to about 10 units of ethylene oxide per molecule and wherein the alkyl groups contain from about 8 to about 12 carbon atoms; and sodium or potassium salts of alkyl ethylene oxide ether sulfates containing from about 1 to about 10 units of ethylene oxide per molecule and wherein the alkyl group contains from about 10 to about 20 carbon atoms.

Water-soluble nonionic surfactants are also useful as secondary surfactant in the compositions of the invention. A particularly preferred paste comprises a blend of nonionic and anionic surfactants having a ratio of from about 0.01:1 to about 1:1, more preferably about 0.05:1. Nonionics can be used up to an equal amount of the primary organic surfactant. Such nonionic materials include compounds produced by the condensation of alkylene oxide groups (hydrophilic in nature) with an organic hydrophobic compound, which may be aliphatic or alkyl aromatic in nature. The length of the polyoxyalkylene group which is condensed with any particular hydrophobic group can be readily adjusted to yield a water-soluble compound having the desired degree of balance between hydrophilic and hydrophobic elements.

Suitable nonionic surfactants include the polyethylene oxide condensates of alkyl phenols, e.g., the condensation products of alkyl phenols having an alkyl group containing from about 6 to 16 carbon atoms, in either a straight chain or branched chain configuration, with from about 4 to 25 moles of ethylene oxide per mole of alkyl phenol.

Preferred nonionics are the water-soluble condensation products of aliphatic alcohols containing from 8 to 22 carbon atoms, in either straight chain or branched configuration, with from 4 to 25 moles of ethylene oxide per more of alcohol. Particularly preferred are the condensation products of alcohols having an alkyl group containing from about 9 to 15 carbon atoms with from about 4 to 25 moles of ethylene oxide per mole of alcohol; and condensation products of propylene glycol with ethylene oxide.

Semi-polar nonionic surfactants include water-soluble amine oxides containing one alkyl moiety of from about 10 to 18 carbon atoms and 2 moieties selected from the group consisting of alkyl groups and hydroxyalkyl groups containing from 1 to about 3 carbon atoms; water-soluble phosphine oxides containing one alkyl moiety of about 10 to 18 carbon atoms and 2 moieties selected from the group consisting of alkyl groups and hydroxyalkyl groups containing from about 1 to 3 carbon atoms; and water-soluble sulfoxides containing one alkyl moiety of from about 10 to 18 carbon atoms and a moiety selected from the group consisting of alkyl and hydroxyalkyl moieties of from about 1 to 3 carbon atoms.

Ampholytic surfactants include derivatives of aliphatic or aliphatic derivatives of heterocyclic secondary and tertiary amines in which the aliphatic moiety can be either straight or branched chain and wherein one of the aliphatic substituents contains from about 8 to 18 carbon atoms and at least one aliphatic substituent contains an anionic water-solubilizing group.

Zwitterionic surfactants include derivatives of aliphatic quaternary ammonium phosphonium, and sulfonium compounds in which one of the aliphatic substituents contains from about 8 to 18 carbon atoms.

Useful cationic surfactants include water-soluble quaternary ammonium compounds of the form $R_4R_5R_6R_7N^+X^-$, wherein $R_4$ is alkyl having from 10 to 20, preferably from 12–18 carbon atoms, and $R_5$, $R_6$ and $R_7$ are each $C_1$ to $C_7$ alkyl preferably methyl; $X^-$ is an anion, e.g. chloride. Examples of such trimethyl ammonium compounds include $C_{12-14}$ alkyl trimethyl ammonium chloride and cocalkyl trimethyl ammonium methosulfate.

Note that some of these components may be handled in solid form in which case they should be considered as part of the powder stream rather than liquid binders.

RATIO OF ANIONIC SURFACTANT/BINDERS TO POWDER STREAM

The ratio of liquid ingredients (anionic surfactant acids and binders) to powder ingredients is limited by the stickiness of the powder produced. A ratio from 1:1 to 1:4 is preferred. Most preferred is from 1:2 to 1:3.

HIGH SHEAR MIXER

A preferred high shear mixer is the Loedige R CB series manufactured by Loedige Maschinenbau GmbH, Paderhorn, Germany. Operated at speed range from 500 to 2000 rpm and preferably cooled to maintain the temperature below 40° C.

The residence time is from 5 to 30 seconds, preferably about 10 seconds. The resulting granules should be further processed to give finished agglomerates as described below. Other suitable high shear mixers are believed to be Zig-Zag Blenders manufactured by P K Niro, Denmark.

Also suitable are the Eirich R batch mixers manufactured by Gustau Eirich, Hardheim, Germany. In this type of batch mixer the agglomerates may be formed directly with a mixing time of about 1 minute without the need for further processing.

The powder stream may be fed to the high shear mixer by any suitable powder handling and conveying system.

The anionic surfactant acid and any other liquid binders will normally be pumped into the high shear mixers through conventional nozzles including spray nozzles.

FURTHER PROCESSING OF THE DETERGENT GRANULES

The granules made by the process described hereinabove are suitable for further processing into detergent agglomerates. This further processing includes the continuing neutralization of the anionic surfactant acid by the particulate neutralizing agent. This may be achieved by further mixing in a moderate speed granulator. Suitable mixers include the Loedige R KM mixers. The detergent agglomerates made by the process comprises anionic surfactant salt, coming from the neutralization of the acid form of the anionic surfactant and particulate neutralizing agent, in an amount of less than 40%, preferably 28% by weight of the agglomerate.

Residence time is from 1 to 10 minutes, preferably about 5 minutes, with cooling if necessary.

Additional liquid or powder streams may optionally be added to the moderate speed granulator, or between the two mixers. Any suitable detergent ingredient may be used, including any of those previously described above.

The resulting particles may then be dried in one or more cooling or drying steps. Suitable equipment includes commercially available fluid bed driers and air lifts.

FINES RECYCLING

Fine particles (less than about 150 μm) may be removed from the final powder stream and may be recycled into the process via the high shear mixer. Any commercially available air separation equipment, in combination, if necessary with suitable filters may be used. Suitable techniques will be familiar to the man skilled in the art. If fines removal and recycling is effectively carried out, then there will be little or no finely ground particulate neutralizing agent detectable in the finished composition. However if the fines removal and recycling operation are not carried out, or are not carried out effectively, then there may some finely ground particulate neutralizing agent present in the finished composition.

The resulting agglomerates should have a bulk density greater than 650 g/l and should be crisp particles of low porosity.

FINISHED DETERGENT COMPOSITION

The agglomerates may be mixed with other powder ingredients to give a free-flowing granular detergent composition. Alternatively the agglomerates themselves may be used as the finished composition. A detergent composition made according to the present invention should comprise from 50% to 100% by weight of the agglomerates, preferably from 80% to 100%.

Other detergent ingredients may be sprayed on to the granular detergent, for example, nonionic surfactants, perfumes, or added as dry powders to the agglomerates, for example, bleach and bleach activators, enzymes, polymers including polyethylene glycol.

EXAMPLE

The detergent agglomerate was prepared by dry neutralization of C11–C13 linear alkyl benzene sulphonate with sodium carbonate. The sodium carbonate (light soda ash ex ICI) was prepared to 5 different particle sizes as defined in samples A to E.

A) Carbonate ground in a pancake jet mill (ex Trade Micronizing)

B) Carbonate ground in an air classifier mill (ex Hosokawa Micron)

C) Carbonate ground in a pin mill (ex Alpine)

D) Carbonate ground in a hammer mill (ex Alpine)

E) Carbonate commercially supplied by ICI (Light soda ash)

| CARBONATE PARTICLE SIZE (μm)[1] | A | B | C | D | E |
|---|---|---|---|---|---|
| MEDIAN (<50%) | 3.4 | 5.7 | 18.3 | 59.6 | 73.2 |
| <90% | 4.2 | 15.3 | 69.1 | 152.8 | 209 |
| SPECIFIC SURFACE AREA ($m^2$/cc) | 1.68 | 1.31 | 0.98 | 0.25 | 0.25 |

1. Carbonate particle size is measured in a MALVERN series 2600 laser particle sizer. The median indicates that 50% by volume of the particles measured are smaller than the particle size given in that row of the table. <90% indicates that 90% by volume of the particles measured are smaller than the particle size given in that row of the table.

The following ingredients were mixed in an Eirich (batch) mixer. The powder ingredients were charged to the mixer first. The liquid ingredients were added last and the resultant agglomerate was formed during a mixing period of 1 minute.

| LIQUIDS | |
|---|---|
| LINEAR ALKYL BENZENE SULPHONIC ACID | 23% |
| PHOSPHONIC ACID | 2% |
| POWDERS | |
| CARBONATE | 21% |
| ZEOLITE | 4–6% |
| PENTA SODIUM TRIPOLYPHOSPHATE | 40% |

-continued

| | |
|---|---|
| SODIUM SILICATE | 6% |
| MISCELLANEOUS (POLYMERS etc.) | to balance |

The resultant agglomerates coming out of the Eirich, were then prepared for physical properties testing and subsequently made into finished product for performance testing as outlined below.

| | A | B | C | D | E |
|---|---|---|---|---|---|
| BLEACHABLE STAIN REMOVAL (PSU)[1] | 0 | −0.8 | −0.6 | −0.7 | −1.0 |
| AGGLOMERATE CAKE STRENGTH[2] | 0 | 2.5 | 6.4 | 10.5 | 9.4 |
| SOLUBILITY GRADE[3] | 3 | 1 | 2 | 2 | 0 |
| DENSITY (g/l) | 850 | 822 | 602 | 600 | 664 |
| AGGLOMERATE MEAN PARTICLE SIZE (μm)[4] | 370 | 336 | 333 | 337 | 347 |

1. The bleachable stain removal is measured as follows: finished product is prepared by mixing 85% by weight of agglomerates with 15% by weight of sodium perborate mixed with a bleach activator. We use a NATIONAL semi automatic Lab J28 twin tub Japanese washing machine. The finished product (70 g) is poured in 30L of water (water hardness is 2.0 mmol $Ca^{2+}$/L, water temperature is 30° C.) containing 1 to 2 kg of preferably soiled load and a set of bleachable stains (coffee, tea, black grapes, etc. . . . ). The overall bleachable stain removal profile of the agglomerate finish product is compared to that of an identical formula prepared by a conventional spray-drying process. The scale goes from −4 to +4 Panel Score Units (PSU), the product scores 0 if it has the same stain removal profile as the reference, a negative number on the PSU scale indicates that the test product performs worse than the reference.
2. The agglomerate cake strength is measured as follows: we put 100 g of agglomerate in a test pot and we subject the sample to a 10 kg load for 2 min. The resulting cake formed is then broken by a traversing needle. The force needed to break the cake is recorded on a scale from 0 to 11 pounds. We target for a product which scores between 0 (the cake breaks easily) to 3 (upper limit for acceptable cake strength).
3. Solubility grades are measured as follows: we pour 90 g of finish product (prepared in the same way as in section 2.) in an acrylic pouch (20×40 cm). The pouch is closed by sewing it, and is put in the same type of washing machine as in section 2 in 30L of water at 30° C. containing 1.5 kg of clean load. After 10 minutes of gentle agitation the pouch is opened and graded with regard to undissolved detergent products remaining on the fabric, on a scale from 0 (bad) to 4 (excellent). We have set a solubility grade target of 3 and above based on the evaluation of granular detergents currently on the market.
4. Agglomerate mean particle size is measured on a standard Tyler sieve. The corresponding weight fractions were converted to a log normal distribution, from which average particle size is recorded.

It can be seen that the agglomerates and finished compositions made according to the invention from sample A (the most finely ground carbonate) give significant benefits in cleaning performance and physical characteristics, when compared to the agglomerates and finished compositions made from samples B–E (carbonates with particle size outside of the present claimed range). The above results also show that the finished detergent composition made according to the present invention from sample A show a cleaning performance comparable to an identical composition made by a conventional spray-dry process.

What is claimed is:

1. A process for making detergent particles comprising the steps of:

providing a particulate neutralizing agent comprising 50% by volume of particles less than 5 μm in diameter and 90% by volume of particles less than 10 μm in diameter;

mixing a stoichiometric excess of said particulate neutralizing agent in a high shear mixer with an anionic surfactant in its acid form so as to neutralize said anionic surfactant; and forming said detergent particles.

2. A process according to either claim 1, wherein the anionic surfactant is an alkyl benzene sulphonic acid.

3. A process according claim 1, wherein the neutralizing agent is a sodium or calcium salt of the carbonate.

4. A process for making a detergent agglomerate according to claim 1, further comprising: (I) agglomerating the detergent particles in a moderate speed granulator/densifier, with or without a separate powder stream, and (II) drying and/or cooling.

5. A detergent agglomerate having a bulk density greater than 650 g/l made by the process of claim 4.

6. A detergent agglomerate made by the process of claim 4, wherein the level of anionic surfactant salt coming from the neutralization of the acid form of the anionic surfactant and particulate neutralizing agent is less than 40% by weight of the agglomerate.

7. A detergent agglomerate made by the process of claim 3, wherein the level of anionic surfactant salt coming from the neutralization of the acid form of the anionic surfactant and particulate neutralizing agent is less than 28% by weight of the agglomerate.

8. A free-flowing granular detergent composition comprising from 50% to 100% by weight of the detergent agglomerates according to claim 5.

9. A free-flowing granular detergent composition comprising from 80% to 100% by weight of the detergent agglomerates according to claim 5.

* * * * *